US006408595B1

(12) United States Patent
Friedman

(10) Patent No.: US 6,408,595 B1
(45) Date of Patent: Jun. 25, 2002

(54) MICROPLATE COVER SEAL APPLICATOR

(75) Inventor: Mitchell A. Friedman, Randallstown, MD (US)

(73) Assignee: Union Scientific Corporation, Randallstown, MD (US)

( * ) Notice: Subject to any disclaimer, the term of this patent is extended or adjusted under 35 U.S.C. 154(b) by 52 days.

(21) Appl. No.: 09/703,462

(22) Filed: Nov. 1, 2000

Related U.S. Application Data

(60) Provisional application No. 60/163,035, filed on Nov. 2, 1999.

(51) Int. Cl.[7] ..... B65B 7/28

(52) U.S. Cl. ..... 53/329; 53/329.4; 53/300; 53/305; 53/316; 53/390

(58) Field of Search ..... 53/300, 329, 329.3, 53/329.4, 305, 316, 390; 100/210

(56) References Cited

U.S. PATENT DOCUMENTS 588,125 A * 8/1897 Bundren ..... 100/210
3,336,865 A * 8/1967 Brand ..... 100/210
3,378,991 A * 4/1968 Anderson ..... 53/329.3
3,392,506 A * 7/1968 Haines ..... 53/329.3
3,693,318 A 9/1972 Balzer et al.
3,738,082 A * 6/1973 Anderson ..... 53/329.4
3,851,445 A 12/1974 Schuh
3,908,342 A * 9/1975 Raque ..... 53/329.4
3,988,981 A 11/1976 McDonald
4,002,009 A 1/1977 Tolosa et al.
4,612,755 A 9/1986 Cavanagh
4,835,945 A 6/1989 Perloff
5,533,880 A 7/1996 Hayakawa et al.
5,622,028 A 4/1997 Harp
5,810,965 A 9/1998 Fwu
5,842,321 A * 12/1998 Jones ..... 53/316

* cited by examiner

*Primary Examiner*—John Sipos
(74) *Attorney, Agent, or Firm*—Whiteford, Taylor & Preston, L.L.P.; Gregory M. Stone, Esq.

(57) ABSTRACT

A microplate cover seal applicator comprising a downwardly spring-biased roller mounted in a pivotal arm which pivots the roller into and out of operative contact with the top face of a microplate. The lower face of the microplate is seated in a well formed in a horizontally moveable platen which is supported on a table-top frame. The platen is manipulated by a rotary handle to repetitively translate the platen in a horizontal forwards and back direction. Suction cups are provided at the base of the frame for temporarily affixing the frame to a work surface, such as a table top surface.

15 Claims, 6 Drawing Sheets

MICROPLATE COVER SEAL APPLICATOR

CROSS-REFERENCE TO RELATED APPLICATIONS

The present application is based upon and gains priority from U.S. Provisional Patent Application Serial No. 60/163,035 filed Nov. 2, 1999 by the inventor herein and entitled "Microplate Cover Seal Applicator."

BACKGROUND OF THE INVENTION

1. Field of the invention

The present invention relates to devices for applying an adhesive-backed cover seal to a microplate and, more particularly, to an improved microplate cover seal applicator having easily manipulatable pressure application means which may be brought into and out of contact with the microplate without significant effort by the user, and an operating mechanism that allows long-term, continuous use of the apparatus without risking injury to the user.

2. Description of the Background

In the chemical processing and testing of liquid samples, disposable plastic trays are often utilized having a plurality of open top wells, the plurality of wells allowing a single test tray to hold a multitude of specimens. Such test trays (or "microplates") ordinarily comprise a lightweight, integral molded plastic disposable unit having a large number of open wells, each of which are configured to receive a minute sample of the analytes to be tested and analyzed.

For several reasons, it has been found preferable to provide the open top face of such microplates with a covering. One key reason for doing so is the necessity of preventing the evaporation of the fluids contained in the wells to ensure the integrity of each test sample. Such covers also serve to prevent the inadvertent spillage of each well's contents during transport from one location to another, prevent cross contamination between individual wells, and provide a generally sterile and controlled environment under which the testing and analysis of the fluids contained in the wells may be carried out.

The covers which are normally applied to such microplates generally comprise a thin, flaccid, pressure sensitive adhesive film configured to be applied to the top face of the microplate. In use, the film is applied to the top, open face of the microplate with its adhesive backing facing the top face of the microplate, such that the film is positioned over each of the individual open top wells. A roll braver is then run back and forth across the top face of the plate several times in all directions in an attempt to ensure uniform adhesion to the plate. Unfortunately, laboratory technicians are often required to seal microplates hundreds of times in a single day, and the long term gripping of a traditional brayer to roll the brayer in all directions over the top surface of the microplate quickly causes hand fatigue and can ultimately lead to such serious conditions as Carpal Tunnel Syndrome.

Attempts have been made in the past to provide an alternate method of applying a cover seal to the open top face of a microplate. For example, U.S. Pat. No. 4,002,009 to Tolosa et al. discloses a tape dispenser and tray sealer device having a rectangular base and upstanding parallel plates which hold a tape roll and a press roll. An oversize, hand-manipulable knob is provided for manual rotation of the press roll. The base is provided with guide rails for a microplate, and a cutter assembly sits beneath the press roller to cut the continuous sheet of tape after it is applied to the plate. In use, an operator places a filled tray on the guide rails and slides the tray towards the press roller. Once the tray comes in sufficient contact with the press roller to allow the press roller to grip the tray, the operator changes his or her grip from the tray to the knob, and rotates the knob to both drive the tray along the base and to apply the cover tape to the top face of the tray as it travels beneath the roller. Such method of applying a sealing tape to a microplate is time consuming and is prone to causing fatigue or even injury in the operator who is required to seal hundreds of plates in a single work shift.

Still other mechanisms have been provided for aiding in the application of a film to a blister type package for holding and dispensing pills. For instance, U.S. Pat. No. 5,622,028 discloses a pharmaceutical unit tray sealing apparatus having a base with a top horizontal surface formed from FORMICA, guides running parallel across the horizontal top face to guide the tray during the sealing operation, and a downwardly spring biased roller which is made operable by an electric motor. In use, an adhesive backed sheet is placed over the tray, and the tray is manually pushed towards the roller until drawn under the roller by its rotation. The roller is mounted in pillow blocks which are moved upward from their at rest position on the base when engaged by a microplate of suitable height. However, no provision is made for allowing a uniform compressive roller force to be applied to a tray regardless of its height.

Likewise, U.S. Pat. No. 4,835,945 to Perloff discloses a press for closing a redi-pak medication card comprising a bed having openings to accommodate a tray. A cavity card having one surface coated in selected areas with a pressure sensitive adhesive is placed on the tray, and then a pivoted cover is brought down and a pressure bar swivelled in place to exert pressure on the cover to seal the card and plastic sheet together. Once again, such a process is quite time consuming for the user who is attempting to seal several hundred cards in a single work shift.

Finally, U.S. Pat. No. 4,612,755 to Cavanaugh discloses a press for laminating a barrier film to a blister pack comprising a two-cycle reciprocatory carriage assembly including a tray for holding a blister pack and reciprocating the blister pack into and out of a housing. During a first cycle, a barrier film is prevented from contacting the blister pack by means of a pair of rollers which back the film away from the blister pack a predetermined distance. During the second cycle, the rollers advance the barrier film toward and in contact with the blister pack to apply the film. Such a device is highly complex and time consuming, making it impractical for use in an environment requiring the constant, repetitive sealing of up to hundreds of units in a single work shift.

Moreover, each of the above-cited references which use a press roller to seal an adhesive sheet to either a blister pack or microplate do not allow multiple bidirectional passes of the microplate beneath the press roller. It has been found that due to imperfections in the top surface area of standard microplate, more than a single two-cycle (i.e., forward and rearward) pass of the microplate and adhesive sheet is often necessary in order to provide a fully secure bond between the adhesive sheet and the top face of the microplate, even when using a resilient roller which might adapt its surface to such varying contours. Where a motor drive is utilized (as in Harp '028), the microplate must be passed under the roller in only one direction, removed from the exit side of the apparatus, placed back on the entry side of the apparatus, passed under the roller. etc., until sufficient passes have been accomplished to provide a sufficient seal. Such process is highly time consuming and inefficient for typical laboratory scenarios in which hundreds of microplates must be sealed and processed each day. Likewise, where a spool of adhesive tape is to be sequentially applied to a microplate (as in Tolosa et al.), reversal of the microplate under the press roller will either remove the cover tape that had just been applied, or result in an additional layer of the adhesive film being applied to the surface of the microplate with the adhesive portion pointing upwards from the top face of the microplate, both of which are undesirable results. Similarly, attempting to pass the microplate below the press roller through more than one bi-directional cycle in which a tape layer is applied in a single bi-directional cycle (as in Cavanagh '755) will likewise result in the unwanted application of multiple layers of adhesive film on the top face of the microplate.

It would therefore be advantageous to provide a microplate cover seal applicator which eases fatigue on the user who is required to apply hundreds of covers in a work shift, while ensuring an assembly which is easy to use, may be manufactured at low cost, and allows the seal to be applied very rapidly.

Further, as microplates are provided in a variety of heights, it would be highly advantageous to provide a press roller which could uniformly apply sealing pressure across the entire width of the top face of a microplate irrespective of the height of the microplate. Such a device should be adaptable so as to enable the press roller mount to be selectively positioned and locked at any desired height which corresponds to the height of the microplate to be sealed, while still enabling the press roller to be vertically displaced with respect to this raised mount position when it comes into contact with the microplate's top face. This would ensure application of a sufficient amount of uniform pressure across the face of a microplate of any height.

Finally, to best ensure uniform application of a sealing force applied from a press roller, it would be advantageous to provide a rigid support for the entire surface area of the bottom of the microplate, as the failure to do so may result in a standard plastic microplate flexing into openings in a support on which it is placed, making it even more difficult to apply a uniform sealing force to the top face of the microplate.

SUMMARY OF THE INVENTION

It is, therefore, an object of the present invention to provide a microplate cover seal applicator which avoids the disadvantages of the prior art.

It is another object of the present invention to provide a microplate cover seal applicator which reduces fatigue on the user.

It is still another object of the present invention to provide a microplate cover seal applicator which is readily adaptable to receive microplates of any height while ensuring uniform force distribution across the width of the top face of the microplate irrespective of its height.

It is yet another object of the present invention to provide a microplate cover seal applicator in which movement of the microplate beneath a force application means is carried out through a moveable carriage supporting the entire bottom surface of the microplate.

It is still yet another object of the present invention to provide a microplate cover seal applicator having means to easily adjust the vertical position of a force-applying means in order to provide a desired sealing force to a microplate of any height, and means to easily lock and release the force-applying means from such position.

It is even yet another object of the present invention to provide a microplate cover seal applicator which is compact and easily transportable from table-top site to table-top site.

It is still even yet another object of the present invention to provide a microplate cover seal applicator which enables multiple, repetitive, bi-directional movement of the microplate under the sealing means.

According to the present invention, the above-described and other objects are accomplished by providing a microplate cover seal applicator comprising a rigid base comprising generally parallel side panels, a microplate support tray slidably mounted between the base side panels, a roller mount pivotally attached to each of the side panels, and a roller freely rotatably mounted within the roller mount. Each of the side panels are attached to two horizontal support bars, each of which in turn are supported above two suction cups enabling the removable but rigid positioning of the device on any flat surface. The microplate support tray is mounted for reciprocating horizontal movement between the side panels of the base, and is operatively connected to a manually operable handle which may be rotated both clockwise and counterclockwise any number of times to repetitively traverse the support tray forwards and rearwards between the side panels and below the roller. The support tray is provided with a shallow well dimensioned to receive a standard multi-well microplate. The roller mount positions the press roller overtop the support tray, and is configured such that the entire roller mount assembly may be pivoted about a pivot point located adjacent the back end of the device to raise the press roller away from the support tray and any microplates mounted thereon. The vertical position of the roller mount, and thus of the roller itself, may be locked in place with respect to the vertical support tray via a locking arm or knob on each side of the roller mount, thus enabling the roller to be used to apply a sealing force to microplates of varying heights. The roller is mounted within the roller mount via sliding blocks which rotatably hold the axle of the roller, which blocks are downwardly biased by resilient means to apply compressive force to the top face of a microplate positioned on the tray. The force applied by the roller may be adjusted through both modifying the height of the roller (through pivoting the roller mount assembly), or through adjusting the compression exerted by the resilient means on each sliding block.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
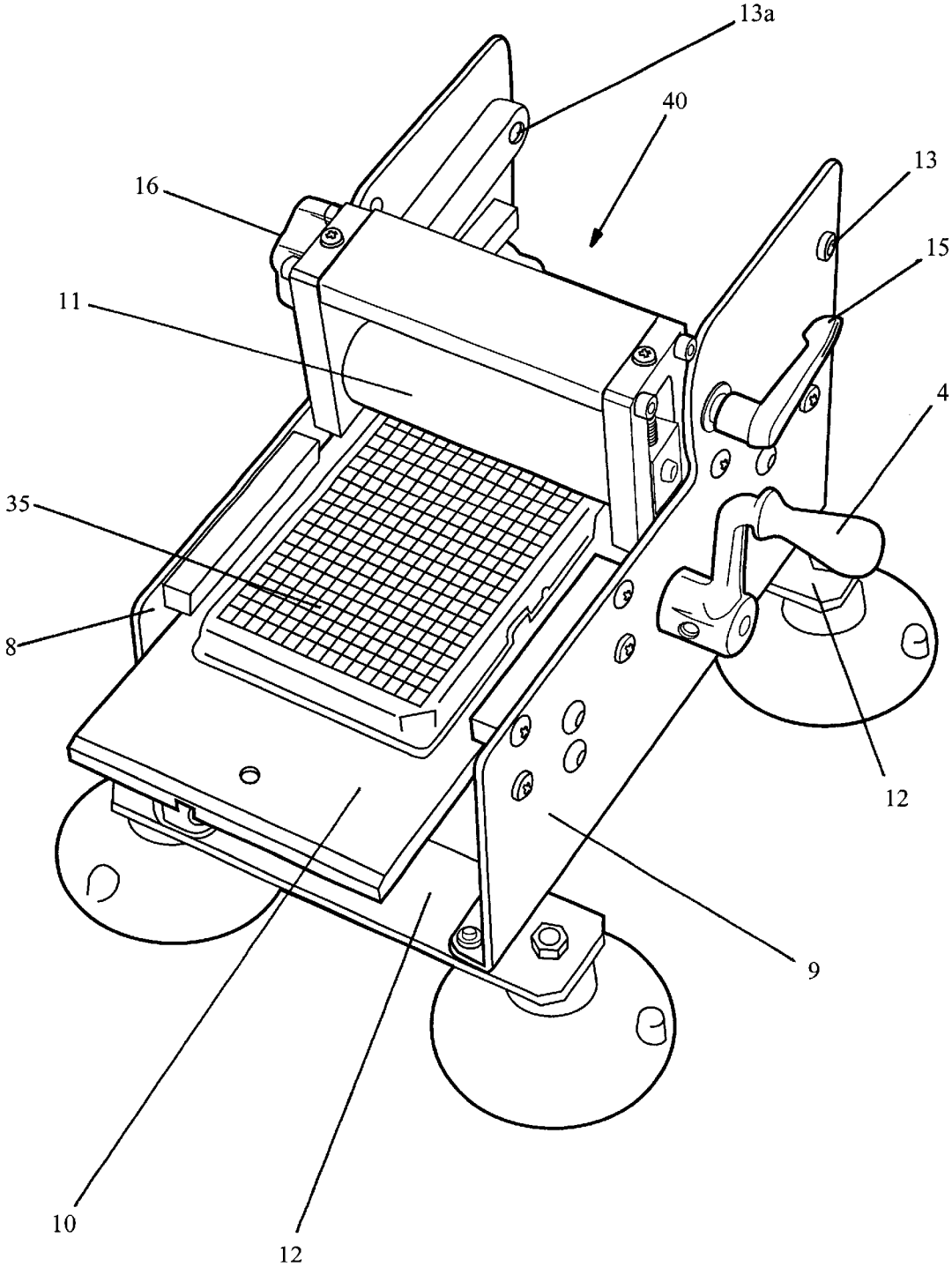
FIG. 1 is a perspective view of a microplate cover seal applicator of the instant invention.

As shown in the perspective view of FIG. 1, the microplate cover seal applicator of the instant invention comprises flat, generally horizontal support bars 12, two parallel side plates 8 and 9 extending upward from support bars 12, a sliding tray 10 above and lying generally parallel to support bars 12 for holding and guiding a microplate 35 positioned thereon and having a cover seal loosely applied to its top surface, and a press roller 11 positioned overtop of sliding tray 10 and housed within a pivoting support bracket (shown generally at 40). A handle 4 extends outward from one side of the device which is operatively connected to sliding tray 10, such that rotation of handle 4 causes sliding tray 10 (as described in greater detail below) to travel forwards and back between each side panel 8 and 9, in turn carrying microplate 35 beneath press roller 11. Two locking handles 15 and 16 are provided on opposite sides of support bracket 40 to allow bracket 40 to vary the vertical position of press roller 11.

Figure 2:
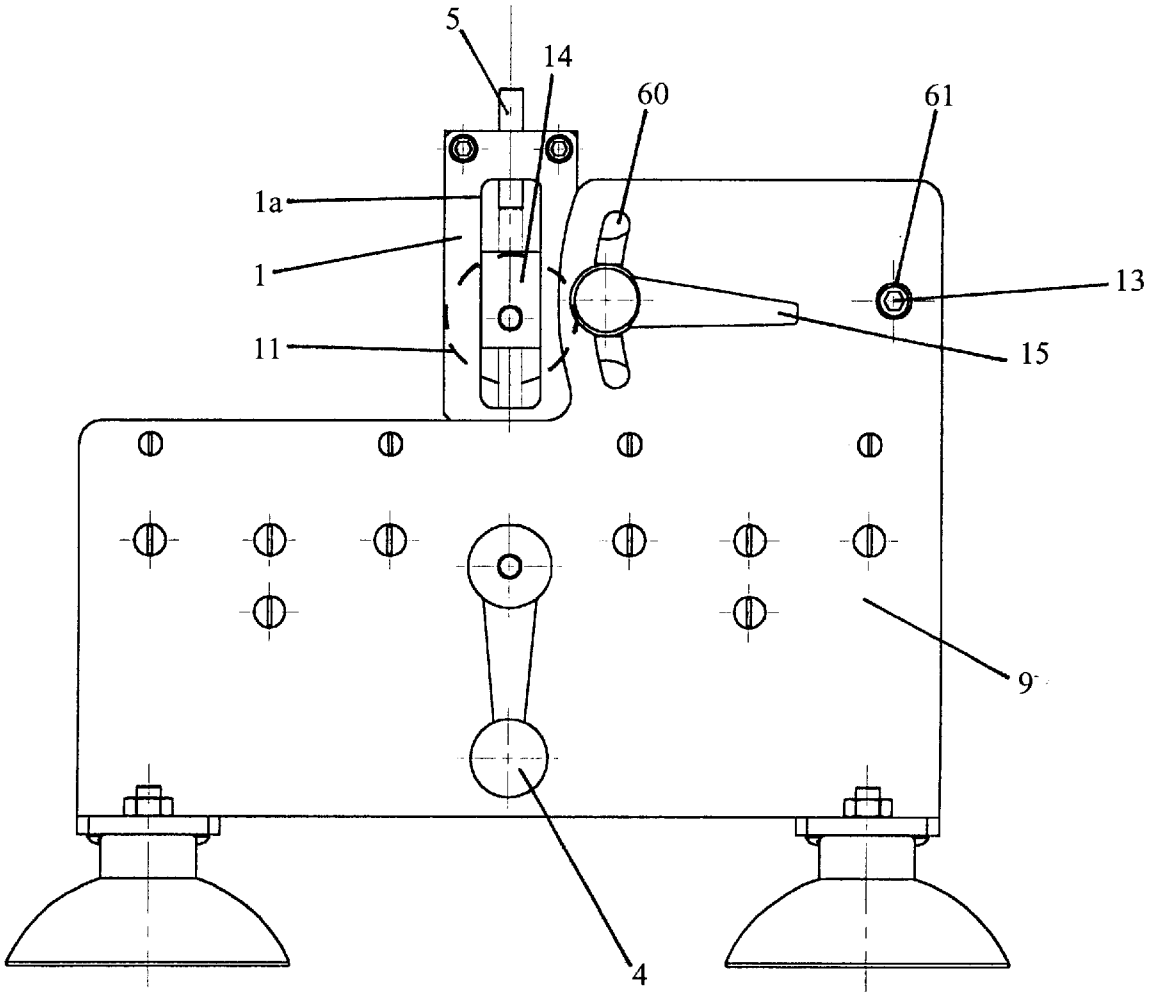
FIG. 2 is a left side view of the microplate cover seal applicator of the instant invention.

As shown more particularly in the left side view of FIG. 2, left side plate 9 (which is a mirror image of right side plate 8) comprises a generally planar panel having a general L-shaped contour. A slot 60 is provided in the upper extent of each side panel which defines a curved slot, the curve contour matching a segment of a circle having a radius equal to the distance between slot 60 and pivot point opening 61. A pivot screw 13 is mounted within each pivot point opening 61. Each pivot screw 13 pivotally mounts a swing arm 1, thus enabling the entire support bracket 40 to pivot about pivot point 61, in turn raising and lowering press roller 11 as needed to provide for varying heights of microplates.

Locking arm 15 and knob 16 are configured such that their axes extend through each slot 60. On the opposite side of each side plate 8 and 9 from their respective locking arm 15 and knob 16, and aligned along the rotational axis of locking arm 15 and knob 16, is a threaded hole 13*a* in each swing arm 1 configured to clamp swing arm 1 in place when locking arm 15 and knob 16 are rotated in a clockwise direction. Thus, an operator may easily release locking arm 15 and knob 16 (by counter-clockwise rotation) and adjust support bracket 40 as required to position press roller 11 a proper height above microplate 35, and finally lock support bracket (and thus the vertical position of press roller 11) in place by again rotating locking arm 15 and knob 16 in a clockwise direction.

Figure 3:
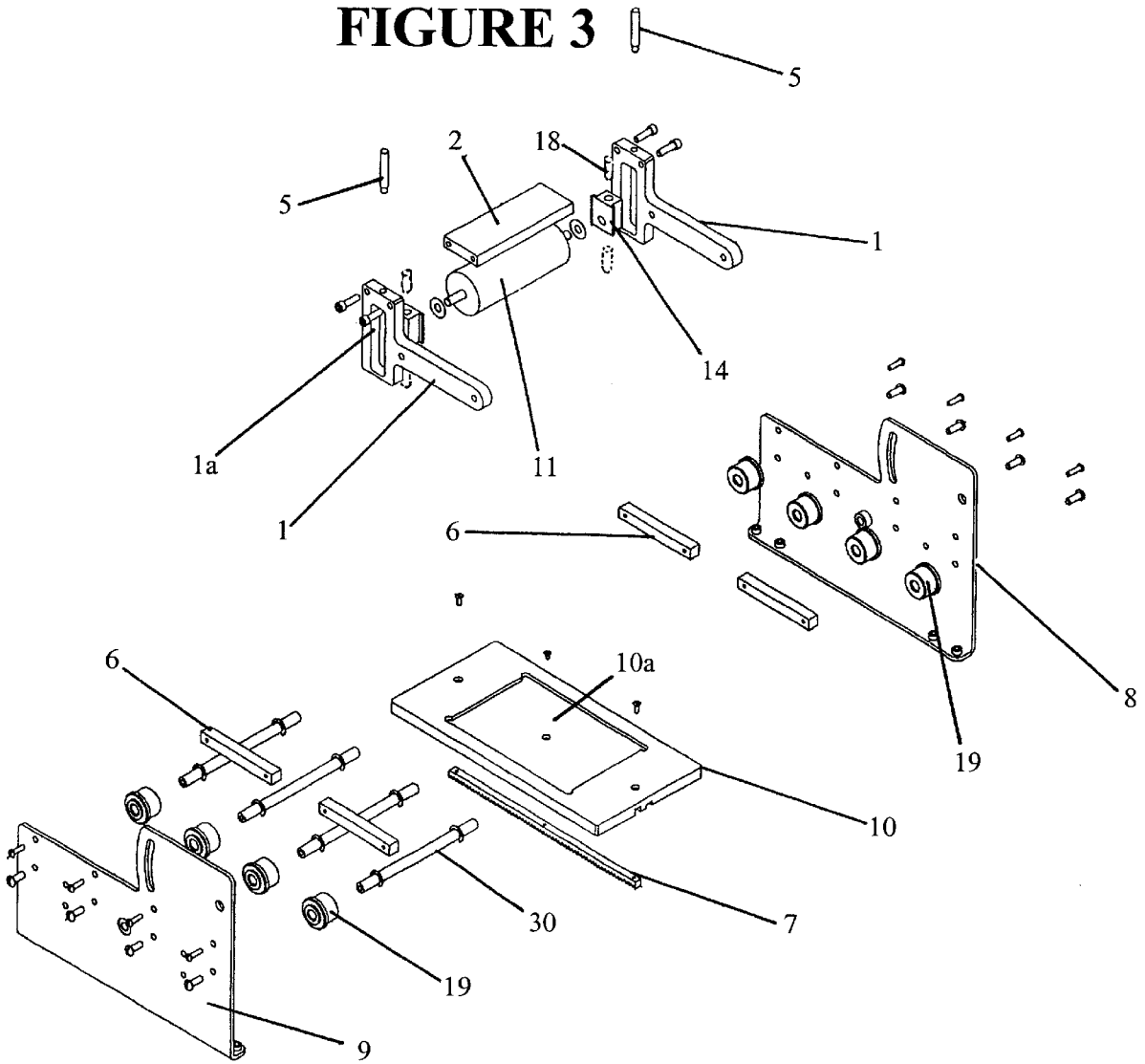
FIG. 3 is an exploded view of the microplate cover seal applicator of the instant invention.

As shown more particularly in the exploded view of FIG. 3, support bracket 40 comprises parallel swing arms 1, each swing arm being provided with a vertical slot 1*a*. Riding within slots 1*a* are sliding blocks 14, each of which has both an upper and lower spring for biasing each sliding block towards a central at rest position within vertical slot 1*a*. The compressive force applied by upper spring 18 may be adjusted via adjustment screw 5. Rotation of adjustment screw 5 in a clockwise direction further compresses top spring 18, thus increasing the downwardly biasing force on press roller 11 and thus the compressive force applied to the top surface of microplate 35. Press roller 11 preferably comprises a compliant elastomer formed into a cylinder, such that an even an uniform force may be applied to the entire top face of a microplate despite minute variance in the contour of the top face. A planar top panel 2 is provided between swing arms 1 and overtop of press roller 11 to provide greater rigidity to support bracket 40.

Support bracket 40 is pivotally mounted to each side plate 8 and 9 via pivot screws 13 such that when locking knobs 15 and 16 are disengaged, support bracket 40 may be raised and lowered by pivoting the press roller end of bracket 40 about pivot screw 13 in order to accept varying heights of microplates 35.

As shown in FIG. 3, sliding tray 10 comprises a generally planar and rectangular panel adapted to slide forward and back between each side plate 8 and 9. Sliding tray 10 is provided with a single well 10*a* which creates a notch dimensioned slightly larger than the bottom contour of a standard microplate. This configuration assures that microplate 35 does not inadvertently shift or slide on sliding tray 10 as it is directed beneath press roller 11 during operation, and likewise ensures that the entire bottom surface area of the microplate is fully supported by a rigid base when a compressive force is applied to its top face.

Affixed to the bottom surface of sliding tray 10 and running generally parallel to its longest axis is a rack gear 7 configured to engage gear 4*b* of handle shaft 4*a,* as explained in greater detail below. Provided below sliding tray 10 and rotatably attached to each side panel 8 and 9 are guide rollers 19 an axles 30 which span the gap between corresponding spindles on each side panel. Guide rollers 19 are provided with a smooth cylindrical exterior which is configured to support an edge portion of the bottom of sliding tray 10 as it travels between side panels 8 and 9. Retaining block 6 are also rigidly attached to the interior walls of each side panel 8 and 9 a spaced distance above guide rollers 19. The space between retaining blocks 6 and guide rollers 19 provides a sufficient gap to allow sliding tray 10 to travel freely between side panels 8 and 9, while ensuring that sliding panel 10 will not inadvertently become dislodged from the apparatus during use.

Figure 4:
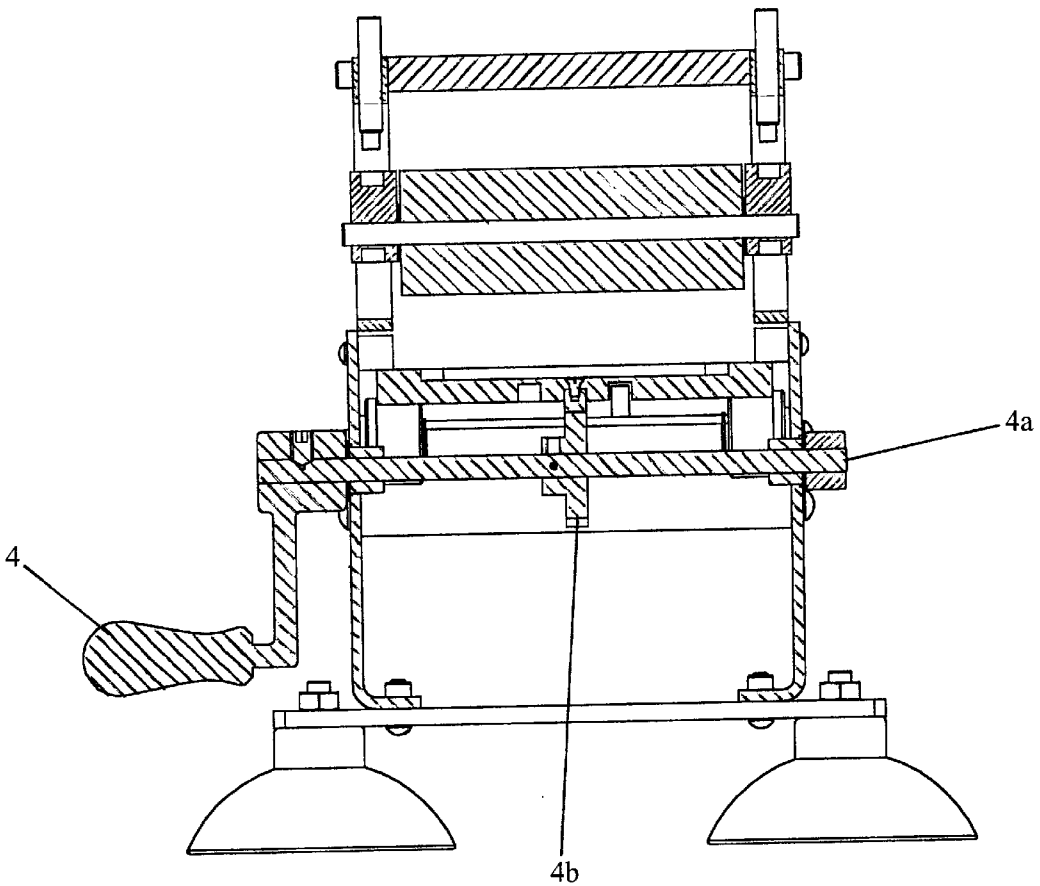
FIG. 4 is a rear sectional view of the microplate cover seal applicator of the instant invention taken along lines A—A of FIG. 2.

As mentioned briefly above and as shown more particularly in the sectional rear view of FIG. 4, operating handle 4 is provided with a handle shaft 4*a* and a gear 4*b* rigidly attached to handle shaft 4*a*. Rotation of handle 4 by an operator causes the rotation of handle shaft 4*a,* in turn rotating gear 4*b*. Because ear 4*b* is operatively engaged with rack gear 7 on the bottom of sliding tray 10, the rotation of and handle 4 will thus cause sliding tray 10 to horizontally translate in a forward or rearward direction (depending upon the direction of rotation of handle 4). As sliding tray 10 translates between side panels 8 and 9, portions of the top face of microplate 35 are gradually brought under the compressive force of press roller 11 such that an even force load is applied across the entire with of the top face of microplate 35 at any instant.

Figure 5:
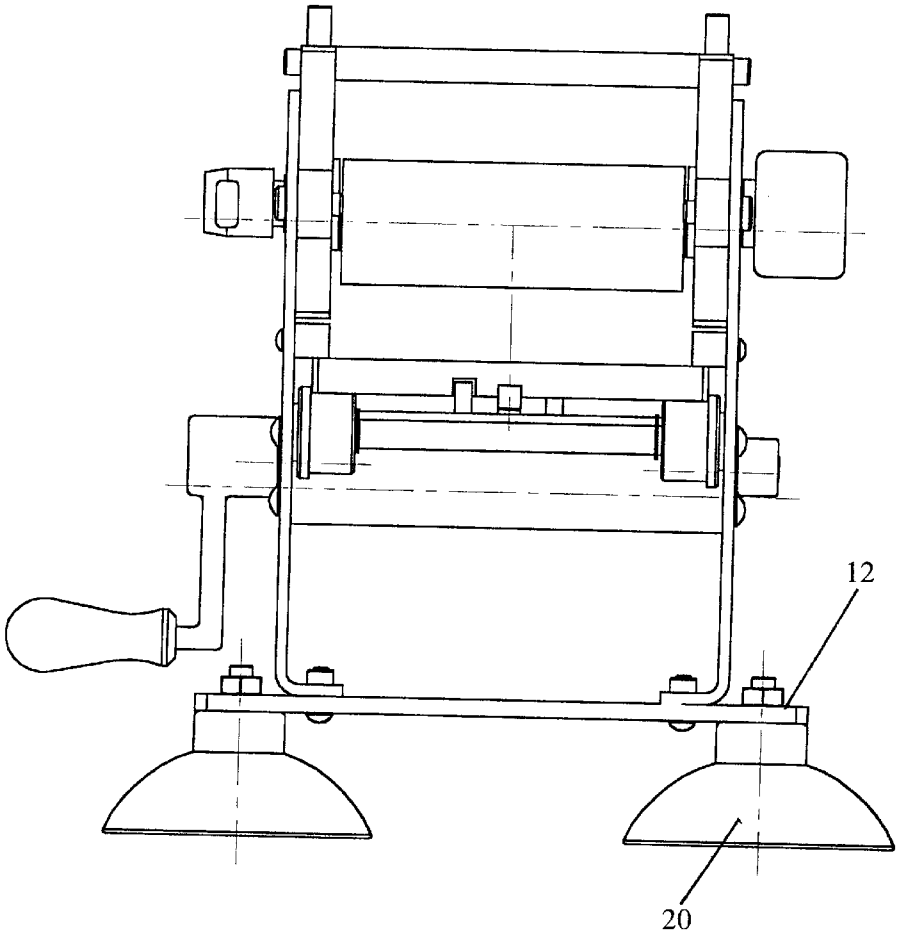
FIG. 5 is a rear view of the microplate cover seal applicator of the instant invention.
Figure 6:
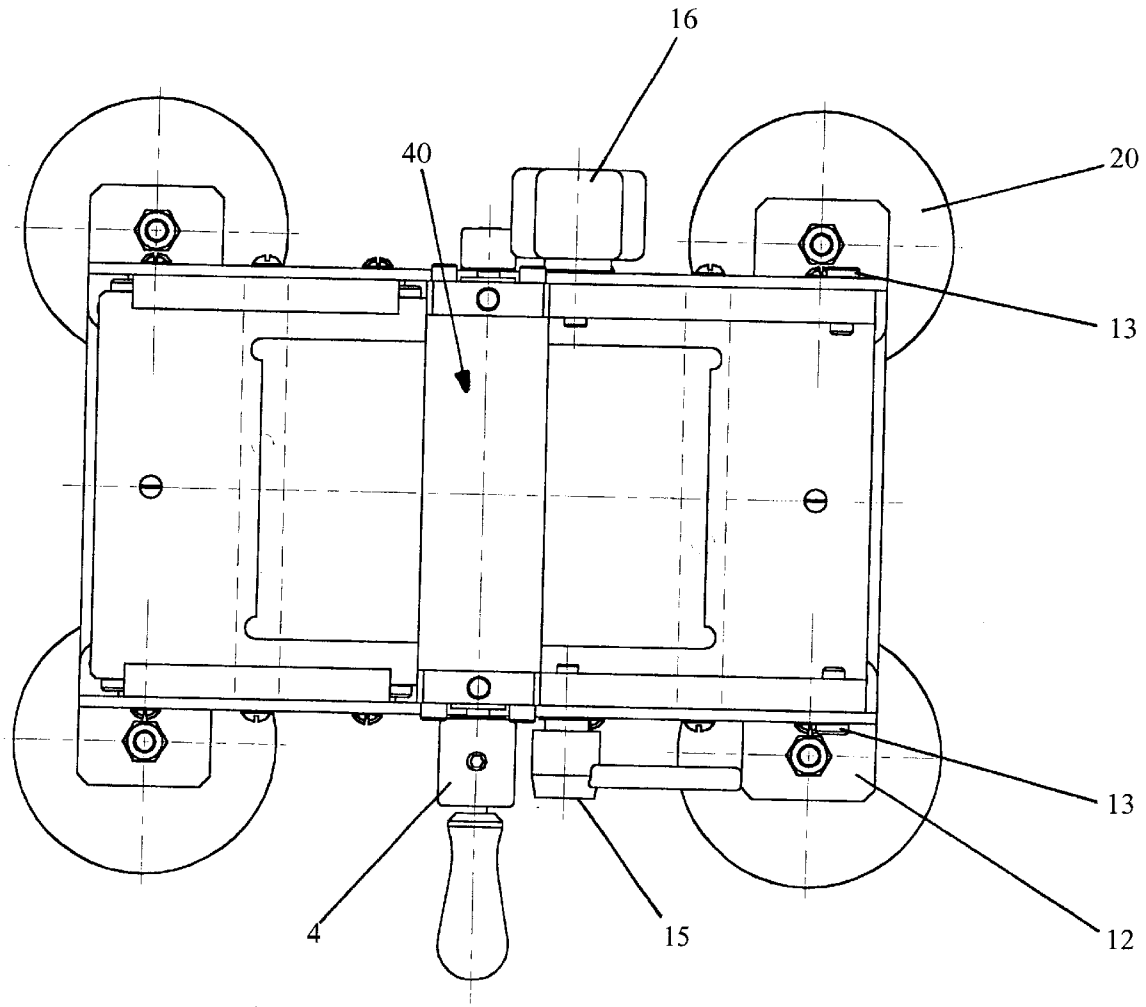
FIG. 6 is a top view of the microplate cover seal applicator of the instant invention.

Referring now to the rear view and top view of the microplate cover seal applicator of FIGS. 5 and 6, respectively, each side panel 8 and 9 (and thus the entire operative system) is supported above support bars 2, and is rigidly attached thereto using standard screws or similar fastening devices. Support bars 12 are, in turn, provided with downwardly oriented suction cups 20. Suction cups 20 allow the microplate cover seal applicator to be held stationary on any planar work surface, such as typical work desk or laboratory table, while ensuring that the apparatus may be easily transported from site to site as needed.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A microplate cover seal applicator comprising:

a base;

a microplate support tray slidably mounted in said base for repetitive, bidirectional movement of said microplate support tray and of a microplate mounted on said support tray;

a roller mount attached to said base above said microplate support tray and fixedly positionable in a variety of vertical positions with respect to said support tray; and a roller freely rotatably mounted within said roller mounts, means for driving said support in either of the two directions while said roller presses on said tray.

2. The microplate cover seal applicator of claim 1, said microplate support tray further comprising a well dimensioned to receive the base of a microplate.

3. The microplate cover seal applicator of claim 2, said well being configured to support the entire bottom surface area of a microplate.

4. The microplate cover seal applicator of claim 1, further comprising:

a handle; and said driving means being operatively connected between said handle and said microplate support tray.

5. The microplate cover seal applicator of claim 4, further comprising retaining means mounted to said base for maintaining said microplate support tray in operative engagement with said driving means.

6. The microplate cover seal applicator of claim 1, said roller mount further comprising:

a pivoting arm having a front end and a back end, said pivoting arm being pivotally attached to said base adjacent said back end;

a vertical slot adjacent said front end;

a mounting block slidably positioned within said vertical slot and rotatably mounting said roller; and biasing means for biasing said mounting block to an at-rest vertical position within said vertical slot.

7. The microplate cover seal applicator of claim 6, said biasing means further comprising a first biasing means positioned within said vertical slot above said mounting block, and a second biasing means positioned within said vertical slot below said mounting block.

8. The microplate cover seal applicator of claim 7, further comprising means for adjusting a compressive force applied by said biasing means on said positioning block.

9. The microplate cover seal applicator of claim 6, further comprising:

a second pivoting arm having a front end and a back end, said second pivoting arm being pivotally attached to said base adjacent said back end;

a vertical slot adjacent said front end of said second pivoting arm;

a second mounting block slidably positioned within said vertical slot of said second pivoting arm and rotatably mounting said roller; and biasing means for biasing said second mounting block to an at-rest vertical position within said vertical slot.

10. A microplate cover seal applicator, comprising:

microplate support means;

means for providing repetitive, bidirectional movement of said microplate support means and of a microplate supported thereon; and non-driven, compressive means for applying a compressive force to the top face of a microplate mounted on said microplate support means, irrespective of a height dimension of said microplate during the movement of said support means in either direction.

11. The microplate cover seal applicator of claim 10, said fixedly positionable compressive means further comprising:

compressive force transfer means;

support means supporting said compressive force transfer means, said support means being adjustable to a variety of vertical positions with respect to said microplate support means; and means for fixing a vertical position of said support means with respect to said microplate support means so as to maintain said support means in a fixed vertical position with respect to said microplate support means during application of a compressive force from said compressive force transfer means.

12. The microplate cover seal applicator of claim 11, said compressive force transfer means further comprising a roller freely rotatably mounted within said support means.

13. The microplate cover seal applicator of claim 12, said roller being variably positionable with respect to said support means.

14. The microplate cover seal applicator of claim 13, further comprising:

biasing means resiliently biasing said roller towards an at rest position with respect to said support means.

15. The microplate cover seal applicator of claim 14, further comprising means for adjusting a compressive force applied by said biasing means on said roller.

* * * * *